US008875430B2

(12) United States Patent
Leboff

(10) Patent No.: US 8,875,430 B2
(45) Date of Patent: Nov. 4, 2014

(54) DISPLAY FRAME

(76) Inventor: Lynn Elizabeth Leboff, Tampa, FL (US)

( * ) Notice: Subject to any disclaimer, the term of this patent is extended or adjusted under 35 U.S.C. 154(b) by 1096 days.

(21) Appl. No.: 12/814,073

(22) Filed: Jun. 11, 2010

(65) Prior Publication Data

US 2011/0305854 A1 Dec. 15, 2011

(51) Int. Cl.
*A47G 1/06* (2006.01)
*A47G 1/12* (2006.01)

(52) U.S. Cl.
CPC ..... *A47G 1/0616* (2013.01); *A47G 1/12* (2013.01)
USPC ..... 40/737; 40/722; 40/743; 40/800

(58) Field of Classification Search
USPC ..... 40/800, 743, 737, 722, 720; 119/251, 119/256, 257
See application file for complete search history.

(56) References Cited

U.S. PATENT DOCUMENTS 83,797 A 11/1868 Schmitt
1,002,910 A * 9/1911 Foote ..... 434/297
3,703,045 A * 11/1972 Nyman ..... 40/720
5,078,093 A * 1/1992 Flaherty ..... 119/256
5,174,054 A 12/1992 Politi
5,197,213 A 3/1993 Borden
5,335,433 A 8/1994 Borden
6,415,739 B1 * 7/2002 Orendorff et al. ..... 119/248
6,438,878 B1 * 8/2002 Fine et al. ..... 40/409
6,510,631 B1 1/2003 Baggarly
6,510,638 B1 1/2003 Wang
7,437,846 B2 * 10/2008 Franco et al. ..... 40/729
8,141,284 B2 * 3/2012 Yang ..... 40/737
2006/0162213 A1 * 7/2006 Einarson ..... 40/765

* cited by examiner

*Primary Examiner* — Gary Hoge
(74) *Attorney, Agent, or Firm* — Kevin P. Crosby; GrayRobinson, P.A.

(57) ABSTRACT

An artifact frame comprised of a hollow container bordered on front, rear, left and right sides and bottom to define an interior cavity into which can be placed ornamental material. On the front or back panel, or side or bottom panels, the artifact to be displayed may be mounted. Any number of mounting configurations are contemplated to be within the scope of the invention. A top panel may also be provided, which may be partially or totally removable to permit access to the interior cavity for the mounting of the artifact and placement of the ornamental material.

12 Claims, 13 Drawing Sheets

DISPLAY FRAME

BACKGROUND OF THE INVENTION

1. Field of the Invention

This invention relates to visual displays, and, more particularly, relates to decorative frames for displaying artifacts such as photographs, artwork, etc., in which the display is constructed to accommodate decorative material to be associated with an ornament the display itself.

2. Background Art

Numerous displays have been proposed the purpose of which is to prominently display artifacts of significance such as photographs, artwork, collectibles, antiques, and the like. Typical displays comprise a frame having means associated therewith for displaying an artifact. The most commons such display is the well-known picture frame. modified forms of this basic display have also been proposed in a wide variety of configurations, some of which permit the placement of ornamental matter around the periphery of the display such as that shown in U.S. Pat. No. 83,797 to Schmitt, U.S. Pat. No. 5,174,054 to Politi, U.S. Pat. Nos. 5,197,213 and 5,335,433 to Borden, U.S. Pat. No. 6,510,613 to Baggarly and U.S. Pat. No. 6,510,638 to Wang. All of the aforementioned patents disclose picture display frames having rectangular or curved hollow frame members adapted to receive decorative material to accentuate the appearance of the display. These displays have an open area in the centers thereof for mounting and display of photographs or other articles.

None of the above-referenced patents disclose, however, an artifact display which can be completely filed with ornamental material so as to completely surround the displayed artifact. The displays of the above cited patents are relatively complex in their construction, adding unnecessarily to the cost thereof. In addition, they also require the type of time-consuming effort to arrange the displayed material that often tends to cause the owner thereof to avoid maintaining or changing the ornamental material, which detracts from the utility of the display.

None of the above-referenced inventions and patent taken either alone or in combination, teaches, suggests or describes the instant invention as claimed.

SUMMARY OF THE INVENTION

The present invention overcomes the disadvantages of the prior art by providing an artifact frame comprised of a hollow container bordered on front, rear, left and right sides and bottom to define an interior cavity into which can be placed ornamental material. On the front or back panel, or side or bottom panels, the artifact to be displayed may be mounted. Any number of mounting configurations are contemplated to be within the scope of the invention. A top panel may also provided, which may be partially or totally removable to permit access to the interior cavity for the mounting of the artifact and placement of the ornamental material.

It is an object of this invention to provide an artifact display which is easy and inexpensive to construct and which permits the display of the artifact and surrounding ornamental material.

It is also an object of the invention to provide an artifact display which is very simple to manipulate and maintain.

It is a further object of this invention to provide an artifact display which can be used to prominently display an artifact and associated ornamental material to create a striking visual impression.

Benefits, other advantages, and solutions to problems have been described above with regard to specific embodiments of the present invention. However, the benefits, advantages, solutions to problems, and any element(s) that may cause or result in such benefits, advantages, or solutions to become more pronounced are not to be construed as a critical, required, or essential feature or element of any or all the claims. The invention is defined solely by the appended claims including any amendments made during the pendency of this application and all equivalents of those claims as issued.

DETAILED DESCRIPTION OF THE PREFERRED AND ALTERNATIVE EMBODIMENT(S)

Figure 1:
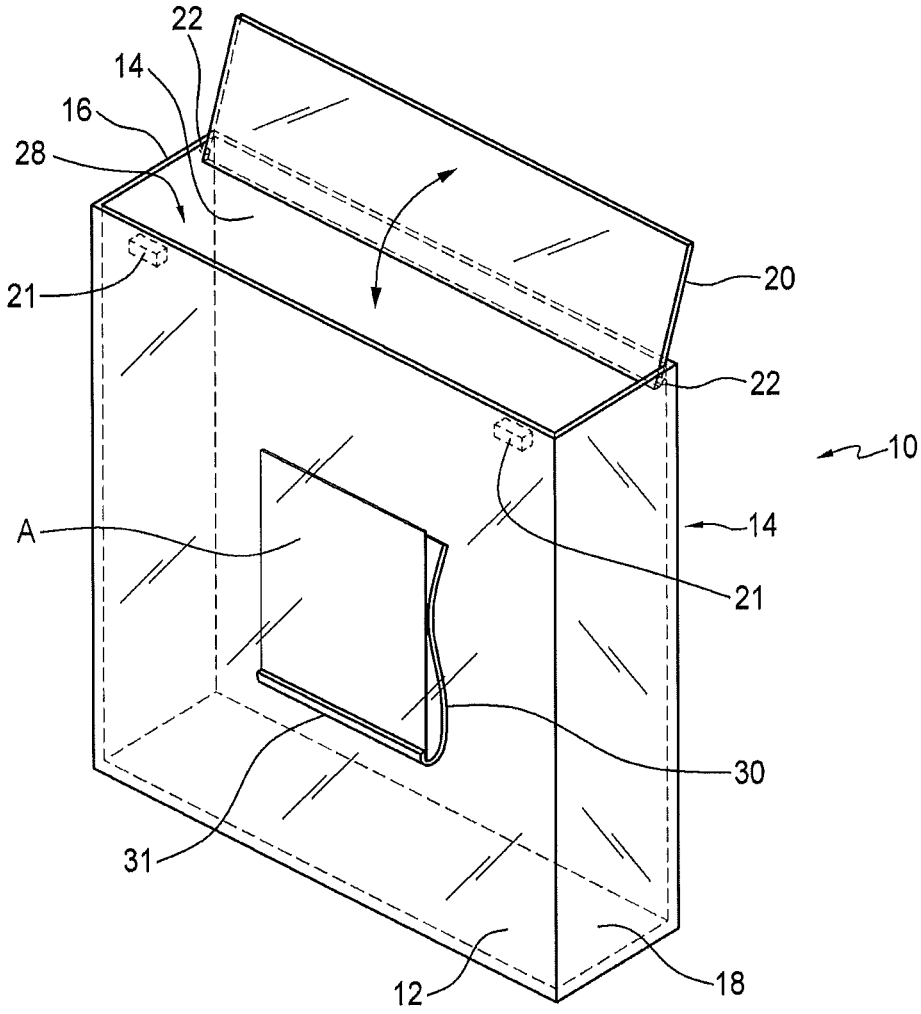
FIG. 1 is a left front perspective view of an artifact display in accordance with a first embodiment of this invention.

Before describing in detail exemplary embodiments that are in accordance with the present invention, it should be observed that the embodiments reside primarily in combinations of structural components and use steps related to an artifact display Accordingly, the apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein. The terms "front", "side", "rear", "top" and "bottom" are merely used for expediency. The actual orientation of such panels is subject to the perspective and frame of reference of the viewer.

Figure 17:
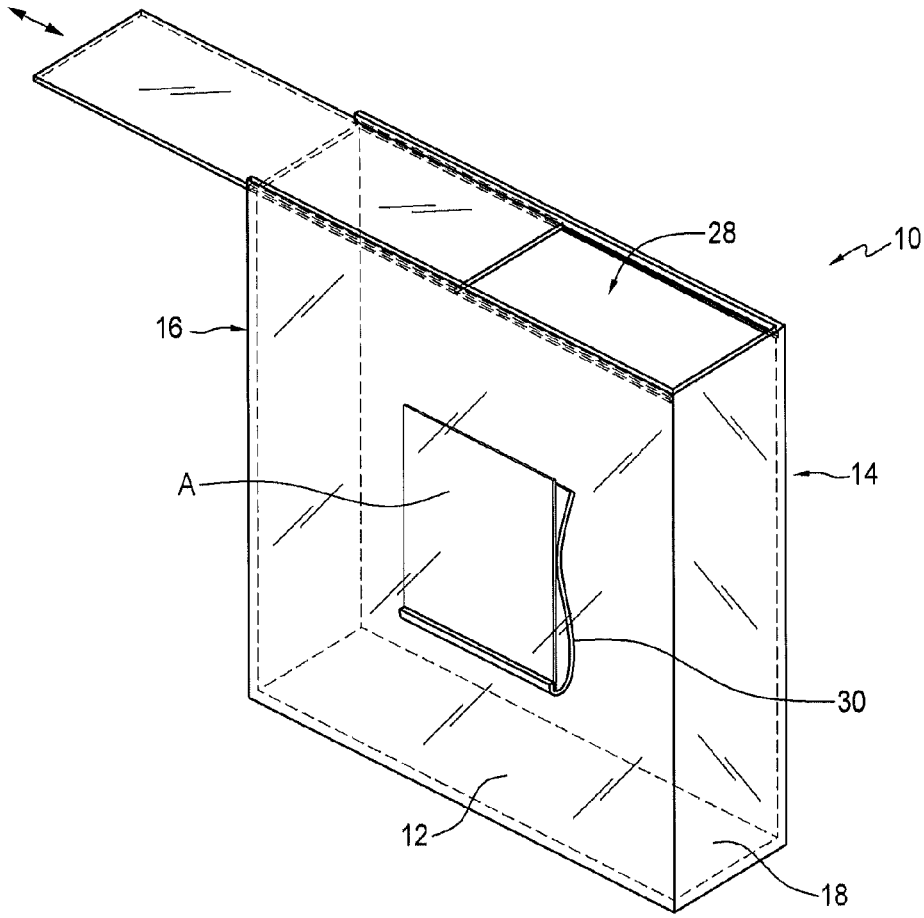
FIG. 17 is a left front perspective view of an artifact display in accordance with a first embodiment of this invention with an alternative top panel.
Figure 18:
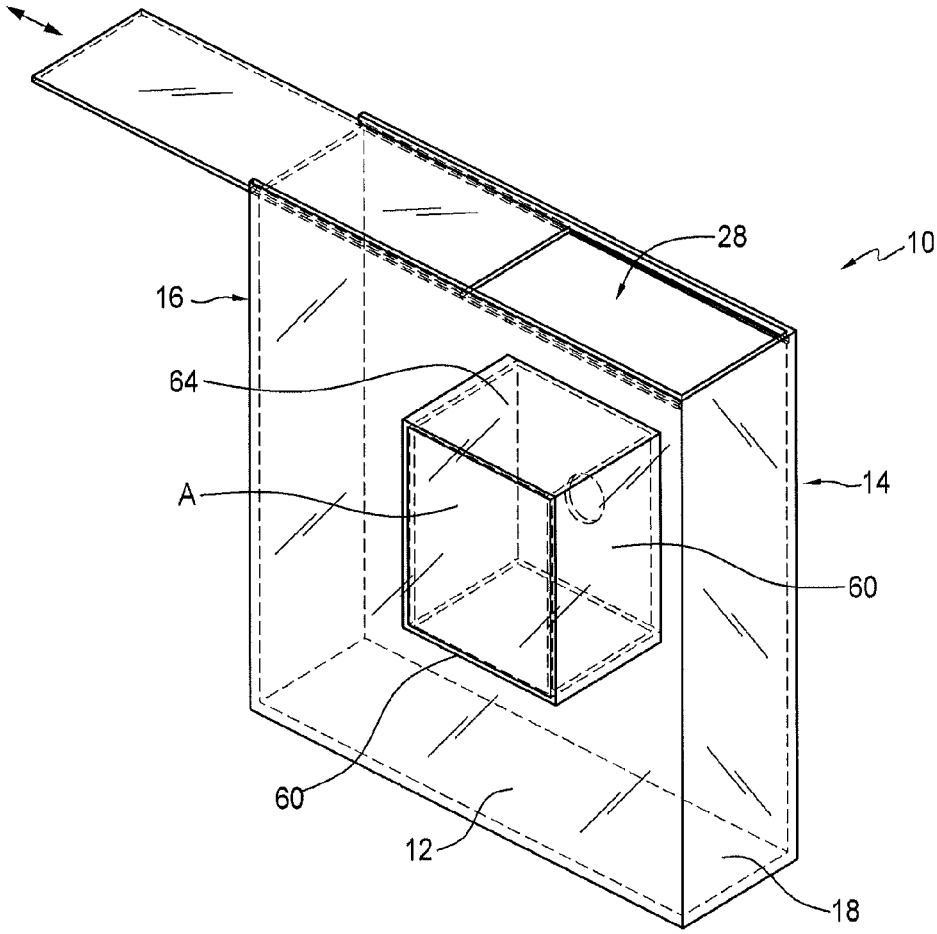
FIG. 18 is a left front perspective view of an artifact display in accordance with a second embodiment of this invention with an alternative top panel.
Figure 19:
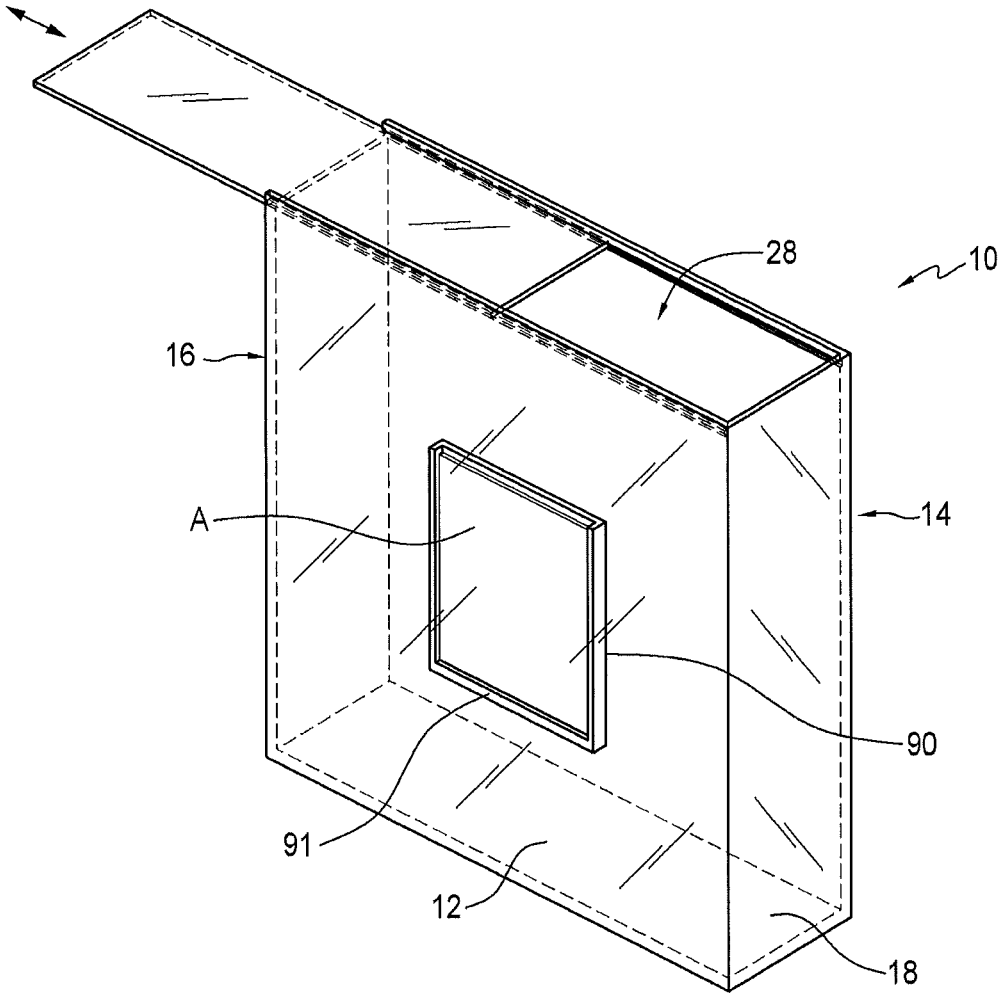
FIG. 19 is a left front perspective view of an artifact display in accordance with a third embodiment of this invention with an alternative top panel.

FIGS. 1 through 5 illustrate a first embodiment of the invention, wherein an artifact display 10 is shown comprised of a rectangular container defined by front panel 12, rear panel 14, right and left side panels 16, 18, top panel 20 and bottom panel 26. Top panel 20 is optional. The foregoing panels comprise a container having an internal cavity or space. Top panel 20 may be hingedly connected to right and left side panels 16, 18, or front or rear panels 12, 14, in any manner, such as by the use of hinges 22. Stop members 21 may be employed to retain top panel in a closed position. Top panel 20 may be removably connected to display 10 in any other manner which will occur to those of skill in the art, an example of which is shown in FIGS. 17-19.

Front panel 12 is preferably manufactured of a clear material such as glass, Lexan®, Lucite® or any of the other polycarbonate resin thermoplastics or transparent thermoplastics such as acrylic glass, acrylic perspex or plexiglass, or any other transparent material. Optionally, right and left side panels 16, 18, rear panel 14, top panel 20 and bottom panel 26 may be made of such material as well, or may be translucent or opaque.

Figure 2:
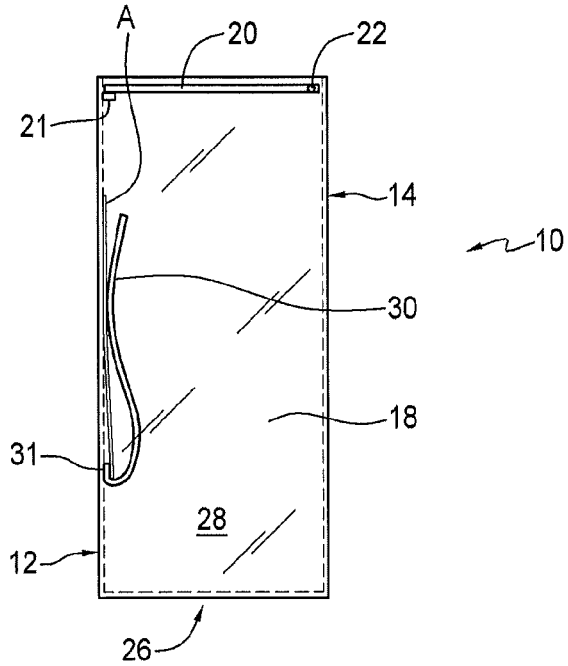
FIG. 2 is a left side elevational view thereof.

In the embodiment shown in FIGS. 1-5, top 20 is hingedly connected to right and left side panels 16, 18 via hinges 22. Stop members 21, connected to an interior surface of front panel 12, may be employed to retain top panel 20 in a substantially horizontal orientation when in the closed position (shown in FIG. 2). Any other suitable means for retaining top panel 20 in the closed position shown in FIG. 2 are contemplated to be within the scope of the invention. Top 20 may be hingedly connected to front panel 12 or rear panel 14 in the alternative.

An artifact retention member is employed in association with the inner surface of front panel 12, such as spring clip 30. Clip 30 is rigidly connected to the interior surface of front panel 12, as, for example, along a connection surface 31. Clip 30 may be made of any suitable material, such as spring steel, aluminum, plastic (including Lexan®, Lucite®) or any of the other resin-based materials available. Clip 30 may be connected to front panel 12 by mechanical fasteners such as rivets, screws, adhesives, ultrasonic welding, or any other fastening arrangement known to those in the art. Alternatively or additionally, clip 30 may be connected to rear panel 14 or side panels 16, 18.

An artifact A, such as a sheet of paper bearing a photograph, artwork, greeting, message or the like, or any artifact which the user desires to display within display 10, such as an antique or piece of jewelry, may be placed between clip 30 and the inner surface of front panel 12. The proximity of clip 30 to the interior surface of front panel 12 retains artifact A against or in close proximity to the interior surface of front panel 12 to maximize the visibility thereof.

Figure 3:
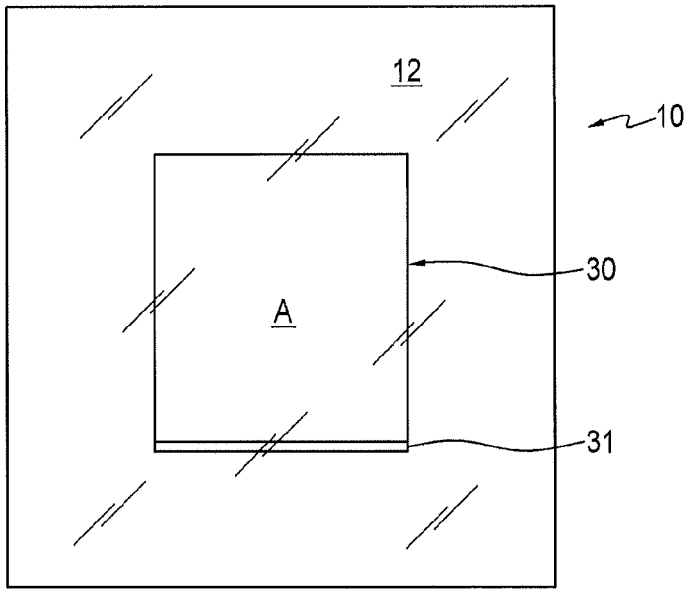
FIG. 3 is a front elevational view thereof.
Figure 4:
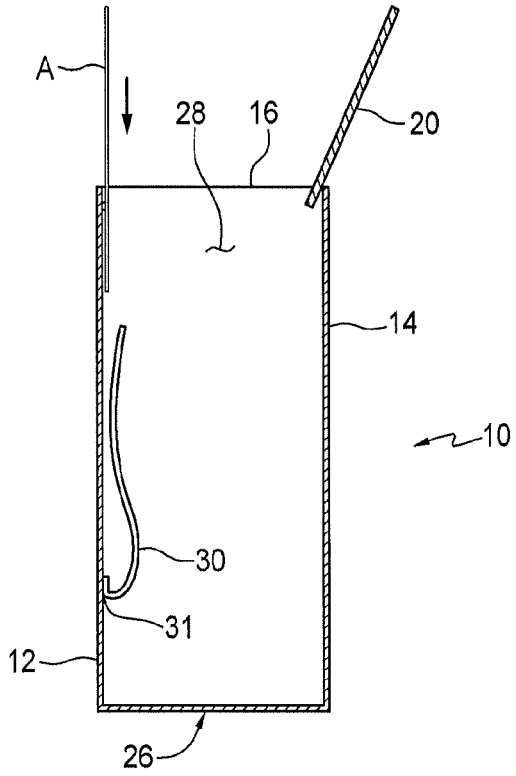
FIG. 4 is a left side cross sectional elevational view thereof.
Figure 5:
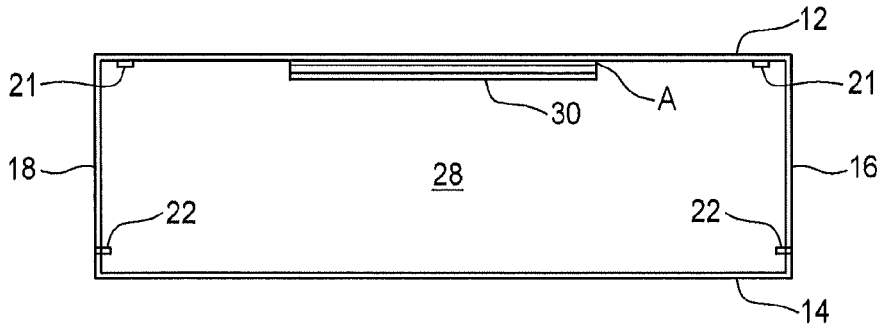
FIG. 5 is top plan view thereof with the top removed.
Figure 6:
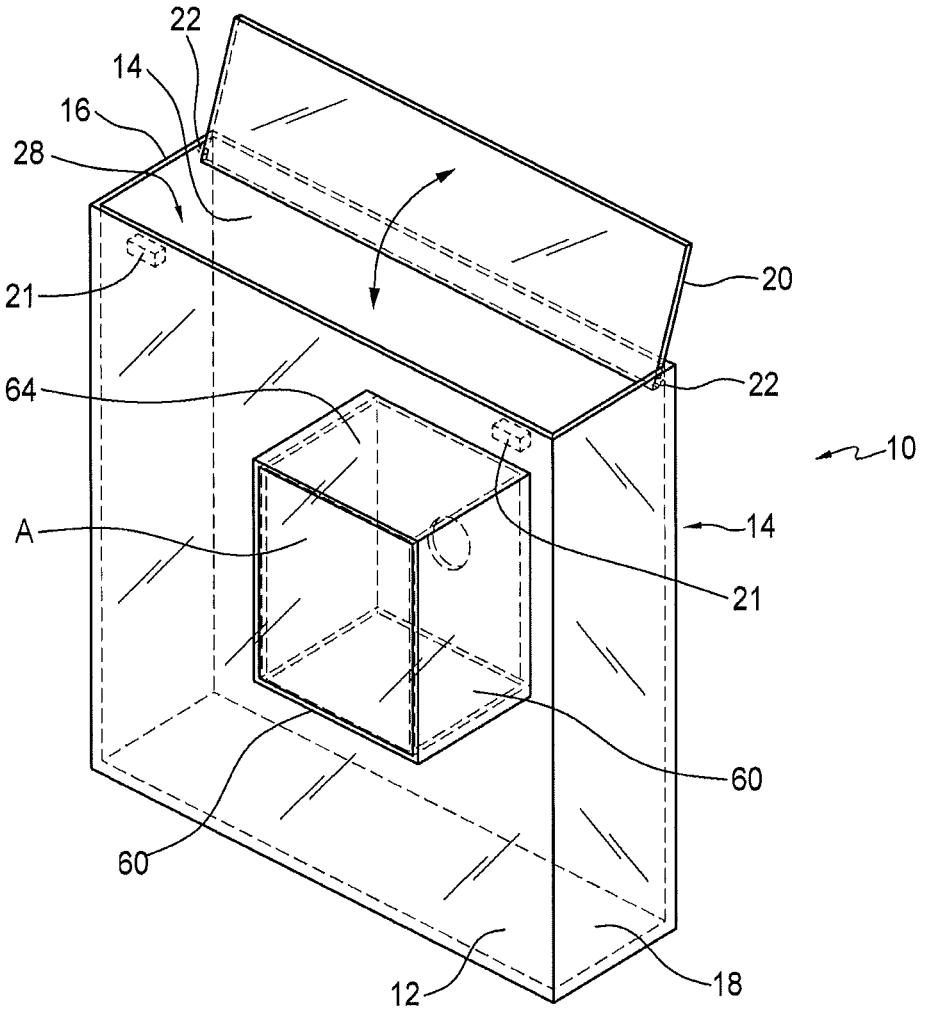
FIG. 6 is a left front perspective view of an artifact display in accordance with a second embodiment of this invention.
Figure 7:
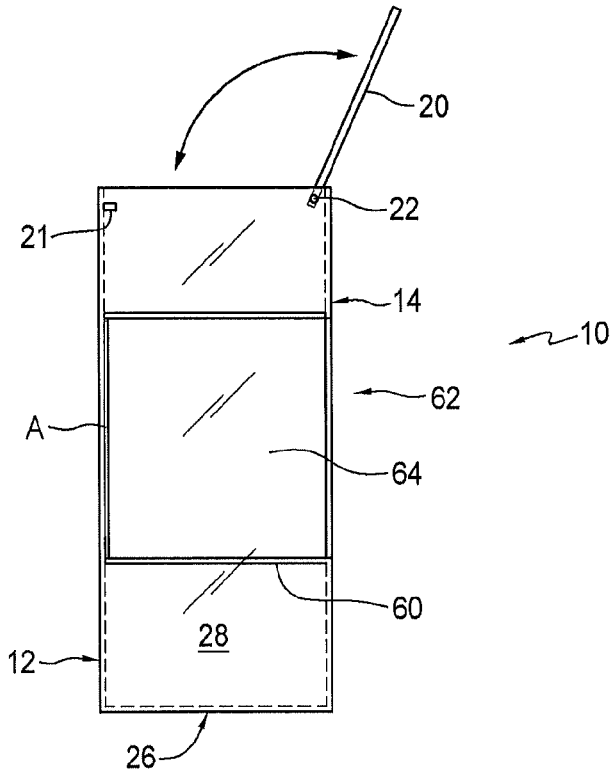
FIG. 7 is a left side elevational view thereof.
Figure 8:
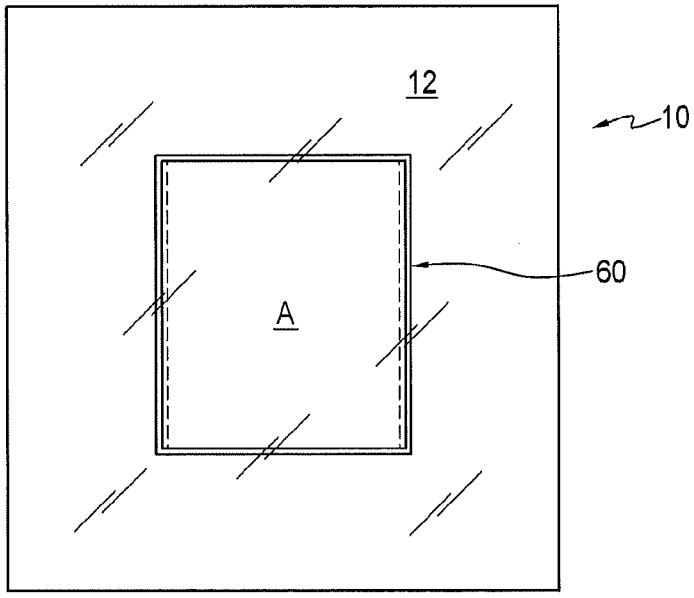
FIG. 8 is a front elevational view thereof.
Figure 9:
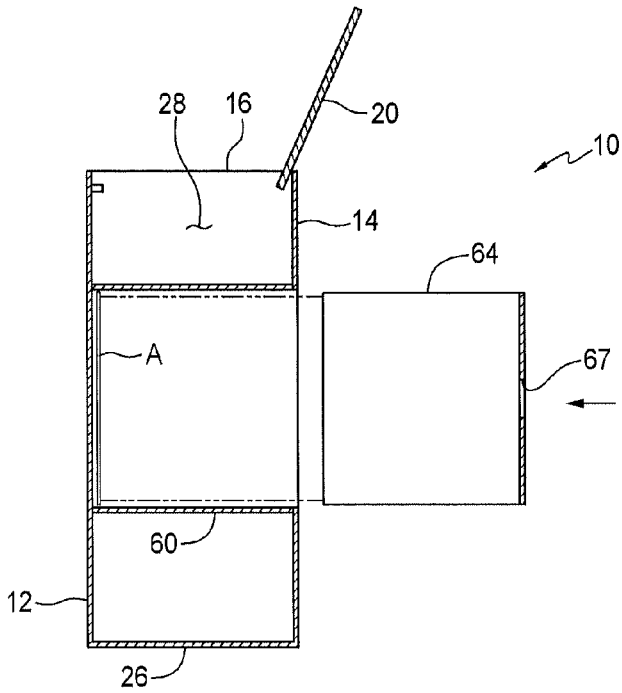
FIG. 9 is a left side cross sectional elevational view thereof.
Figure 10:
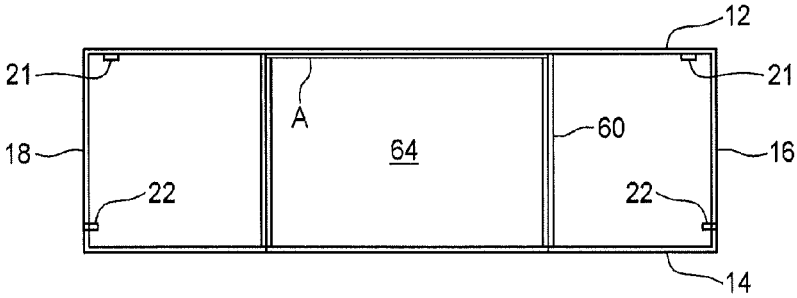
FIG. 10 is a top plan view thereof with the top removed.
Figure 11:
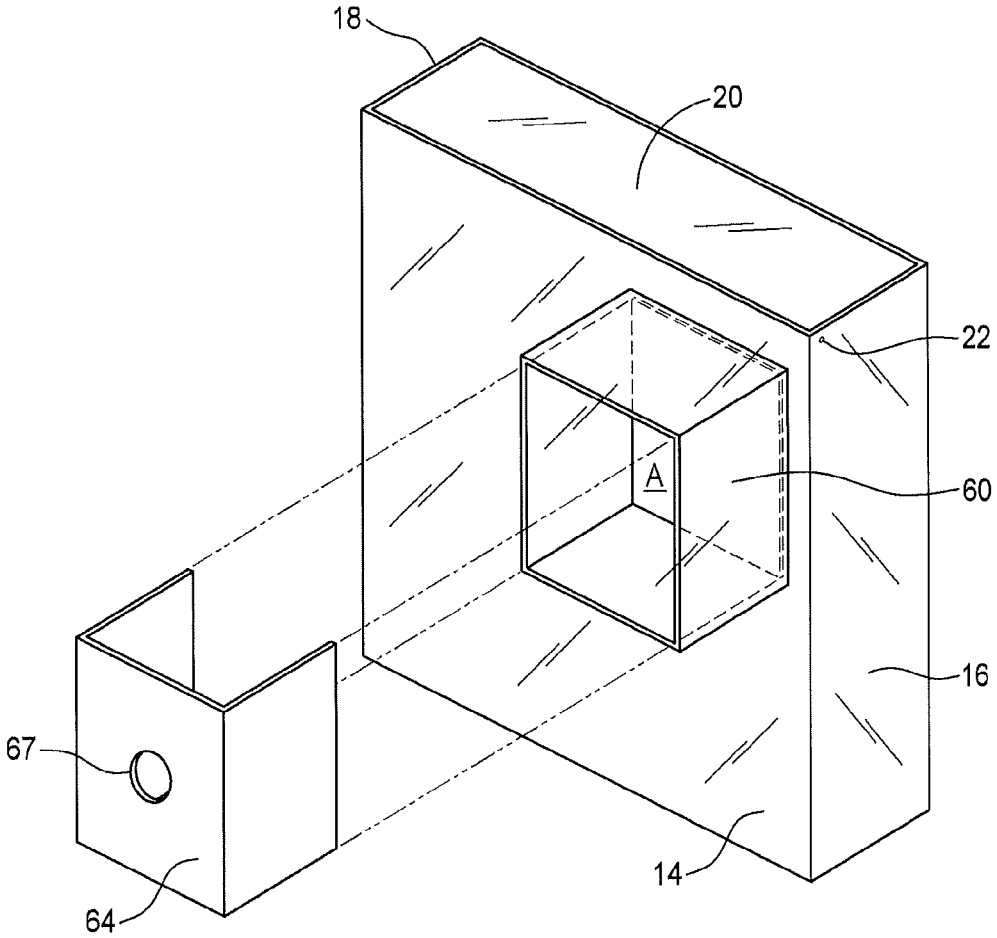
FIG. 11 is a right rear perspective view thereof.
Figure 12:
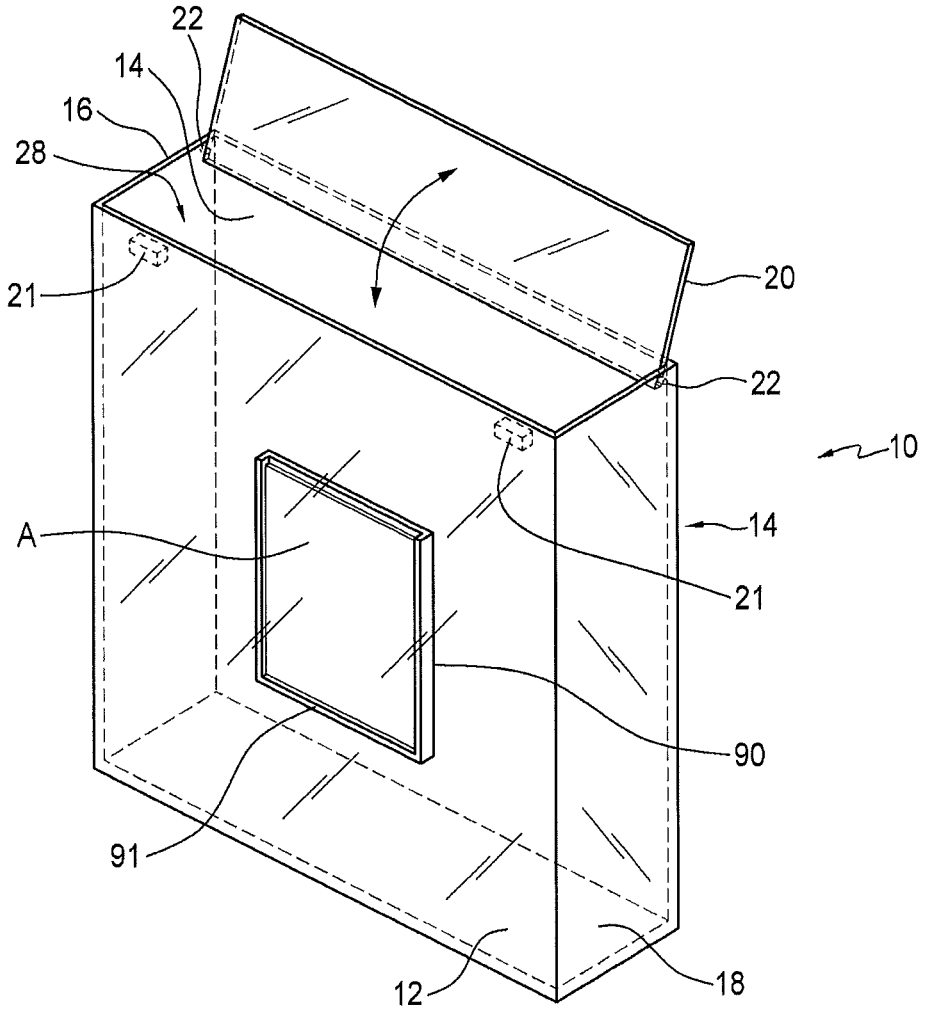
FIG. 12 is a left front perspective view of an artifact display in accordance with a third embodiment of this invention.
Figure 13:
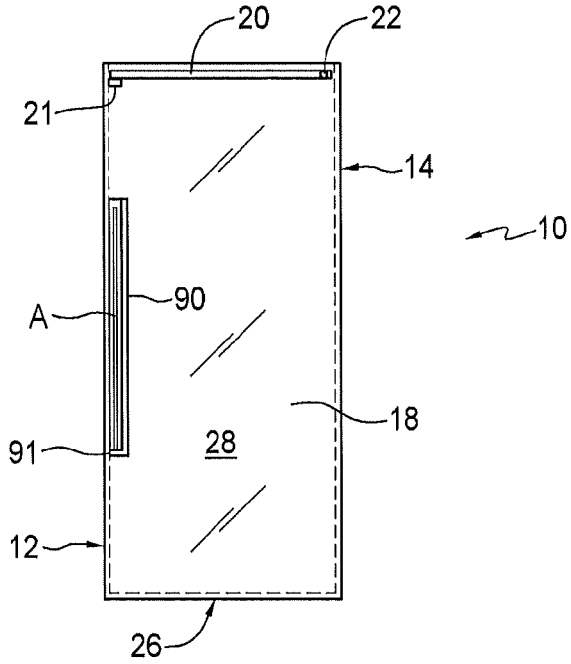
FIG. 13 is a left side elevational view thereof.
Figure 14:
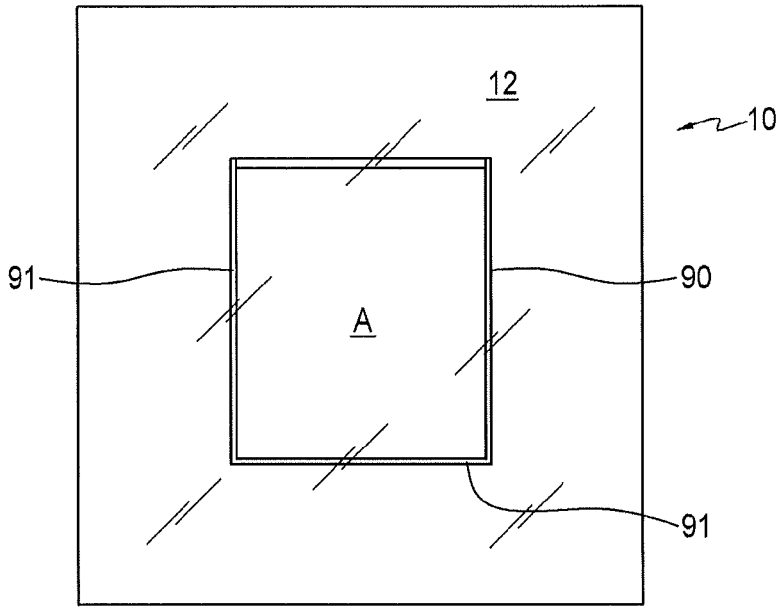
FIG. 14 is a front elevational view thereof.
Figure 15:
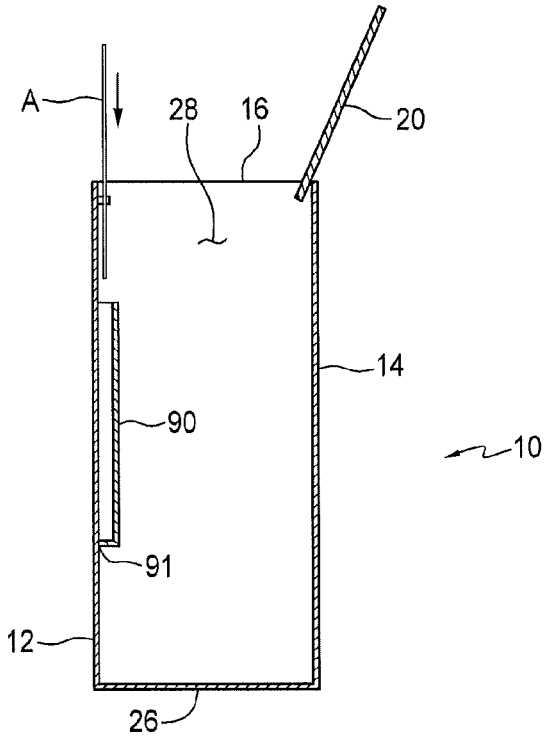
FIG. 15 is a left side cross-sectional elevational view thereof.
Figure 16:
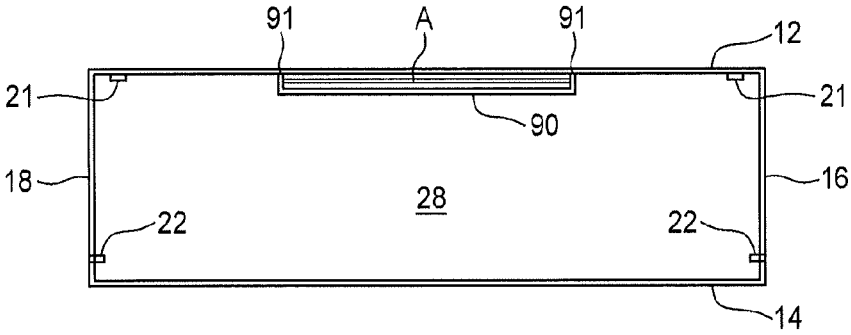
FIG. 16 is a top plan view thereof with the top removed.

Once artifact A is positioned within clip 30 as shown in FIGS. 1-3 and 5, decorative material (not shown) may be introduced into cavity 28. Preferably, cavity 28 will be filled with such decorative material so that the appearance of display 10 when viewed in front elevation as shown in FIG. 3 will be quite dramatic. The same visual effect is achieved as to any side, top or bottom panel made of transparent material. Decorative material of any sort may be employed in connection with the invention, including stones, sand, candy, flowers, shells, etc. There is no limit to the material which can be used to fill cavity 28.

In order to change the appearance of display 10, all that need be done is to open or remove top panel 20 (if present), remove the decorative material, preferably by simply inverting display 10 and pouring the decorative material out, removing existing artifact A, inserting a different artifact into clip 30, re-introducing decorative material of any type into cavity 28 and closing top panel 20 (if present). In this way, an entirely new decorative artifact display is achieved.

Referring now to FIGS. 6-11, a modified embodiment of the invention is shown, wherein clip 30 is replaced by hollow sleeve 60. Sleeve 60 is connected to the interior surface of front panel 12 and/or the interior surface of rear panel 14, in any suitable manner, such as ultrasonic welding or by use of adhesive material. Sleeve 60 is preferably manufactured of the same material which front panel 12 is manufactured of, although sleeve 60 may be made of any other material. Sleeve 60 creates an internal chamber into which artifact A can be placed in registry with the inner surface of front panel 12, whereupon retention member 64 is placed within the cavity formed by sleeve 60 so as to retain artifact A in position. Retention member 64 may employ a gripping means such as finger recess 67 to facilitate the removal and insertion thereof into sleeve 60. Sleeve 60 separates the cavity which it encloses from cavity 28 within display 10. Therefore, the decorative material may be placed within cavity 28 and removed therefrom without disturbing artifact A. Top panel 20 is opened or removed to allow access to cavity 28 for purposes of introducing or removing the decorative material thereinto or therefrom.

FIGS. 12-16 show a third embodiment of the invention, wherein the artifact retention apparatus 30 is replaced by a retention sleeve defined by a rear retention panel 90 which is connected to the inner surface of front panel 12 along a connection seam 91 in a manner similar to that shown in connection with FIGS. 1-5. However, instead of a spring loaded clip 30, a fixed panel 90 is employed, which defines a space S between the inner surface of front panel 12 and retention panel 90 into which can be placed and removably stored an artifact. The distance between retention panel 90 and the inner surface of front panel 12 will depend upon the type of artifact to be displayed.

As stated previously, decorative material may be placed within cavity 28 after artifact A is inserted in sleeve S. Seam 91 may be colored so as to accentuate and/or outline the artifact.

It will be appreciated that, as top panel 20 may be associated with display 10 in any manner which will occur to those of skill in the art, a slideably, removably connected top panel 20 may be employed, as shown in FIGS. 17-19. As discussed above, top panel 20 may be associated with display 10 in any suitable manner. Alternatively, an opening may be provided in top panel 20 for the introduction and removal of decorative material. Further in the alternative, top panel 20 may be omitted altogether without departing from the scope of the invention.

It is to understood that the rectangular shape of the display 10 shown herein is intended as a mere example. The display 10 may be provided in any shape, such as circular, oval, elliptical, heart-shaped, triangular, etc., any shape being considered within the scope of the invention.

The embodiments shown in the present disclosure are intended to be nearly exemplary, and those skilled in the art will be able to make numerous variations and/or modifications thereto without departing from the spirit of the present invention. All such variations and modifications are intended to be within the scope of the present invention, as defined by the appended claims.

What is claimed is:

1. An artifact display, comprising:

a housing defined by a transparent front panel and at least one other panel, the front panel and the at least one other panel defining a hollow interior cavity within the display;

the front transparent panel defining an interior surface thereof and an area when viewed in elevation;

an artifact retention structure adapted to retain the artifact substantially in registry with and adjacent to the front panel, the artifact retention structure defining an area on the front panel that is smaller than the area of the front panel;

wherein the hollow interior cavity is adapted to receive decorative material which is visible through the transparent front panel, such that the artifact is displayed and visible through the transparent front panel and surrounded by the decorative material, providing a pleasant visual effect.

2. The artifact display of claim 1, wherein the artifact retention structure is comprised of a hollow sleeve and a retention member.

3. The artifact display of claim 2, wherein when the retention member is disposed within the sleeve the artifact retention structure retains the artifact in position adjacent the inner surface of the front panel.

4. The artifact display of claim 1, further comprising a top panel which is moveable between a first position in which it covers at least a portion of the cavity and a second position in which it permits access to at least a portion of the cavity.

5. An artifact display, comprising:

a housing defined by a transparent front panel and at least one other panel, the front panel and the at least one other panel defining a hollow interior cavity within the display;

the front transparent panel defining an interior surface thereof a area when viewed in elevation;

an artifact retention structure fixedly connected to the front panel and adapted to retain the artifact substantially in registry with and adjacent to the front panel, the artifact retention structure defining an area on the front panel that is smaller than the area of the front panel;

wherein the hollow interior cavity is adapted to receive decorative material which is visible through the transparent front panel, such that the artifact is displayed and visible through the transparent front panel and surrounded by the decorative material, providing a pleasant visual effect.

6. The artifact display of claim 5, wherein the artifact retention structure is comprised of a hollow sleeve and a retention member.

7. The artifact display of claim 6, wherein when the retention member is disposed within the sleeve the artifact retention structure retains the artifact in position adjacent the inner surface of the front panel.

8. The artifact display of claim 5, further comprising a top panel which is moveable between a first position in which it covers at least a portion of the cavity and a second position in which it permits access to at least a portion of the cavity.

9. An artifact display, comprising:

a housing defined by a transparent front panel and at least one other panel, the front panel and the at least one other panel defining a hollow interior cavity within the display;

the front transparent panel defining an interior surface thereof and an area;

an artifact retention structure fixedly connected to either the front panel or the at least one other panel adapted to retain the artifact substantially in registry with and adjacent to the front panel, the artifact retention structure defining an area on the front panel that is smaller than the area of the front panel;

wherein the hollow interior cavity is adapted to receive decorative material which is visible through the transparent front panel, such that the artifact is displayed and visible through the transparent front panel and surrounded by the decorative material, providing a pleasant visual effect.

10. The artifact display of claim 9, wherein the artifact retention structure is comprised of a hollow sleeve connected to at least one of the front and the at least one other panel, and a retention member.

11. The artifact display of claim 10, wherein when the retention member is disposed within the sleeve the artifact retention structure retains the artifact in position adjacent the inner surface of the front panel.

12. The artifact display of claim 9, further comprising a top panel which is moveable between a first position in which it covers at least a portion of the cavity and a second position in which it permits access to at least a portion of the cavity.

* * * * *